US008851778B2

(12) United States Patent
Neto et al.

(10) Patent No.: US 8,851,778 B2
(45) Date of Patent: Oct. 7, 2014

(54) CONTENT-RESERVOIR/PRODUCT-APPLICATOR ASSEMBLIES, AND PACKAGES

(75) Inventors: Alfredo Rossi Neto, São Paulo (BR); Renato Wakimoto, São Paulo (BR)

(73) Assignee: Natura Cosmeticos S.A., Itapecerica da Serra - SP (BR)

( * ) Notice: Subject to any disclaimer, the term of this patent is extended or adjusted under 35 U.S.C. 154(b) by 1680 days.

(21) Appl. No.: 11/996,881

(22) PCT Filed: Jul. 26, 2006

(86) PCT No.: PCT/BR2006/000150

§ 371 (c)(1),
(2), (4) Date: Mar. 19, 2010

(87) PCT Pub. No.: WO2007/012167

PCT Pub. Date: Feb. 1, 2007

(65) Prior Publication Data

US 2010/0166489 A1 Jul. 1, 2010

(30) Foreign Application Priority Data

Jul. 27, 2005 (BR) ..... 0503100

(51) Int. Cl.
*B43K 7/00* (2006.01)
*A45D 40/26* (2006.01)
*A45D 34/04* (2006.01)

(52) U.S. Cl.
CPC ..... *A45D 40/261* (2013.01); *A45D 34/041* (2013.01)
USPC ..... 401/209; 401/156; 401/183

(58) Field of Classification Search
USPC ..... 401/209, 152–169, 132, 210, 213, 216
See application file for complete search history.

(56) References Cited

U.S. PATENT DOCUMENTS 2,444,004 A * 6/1948 Chesler ..... 401/158
3,100,477 A * 8/1963 Ermel ..... 401/209
3,223,289 A * 12/1965 Bouet ..... 401/157

(Continued)

FOREIGN PATENT DOCUMENTS

| | | |
|---|---|---|
| DE | 94 14 607.1 | 12/1994 |
| FR | 2 537 093 | 6/1984 |
| GB | 2 082 124 | 3/1982 |
| WO | WO 96/18571 | 6/1996 |

OTHER PUBLICATIONS

International Search Report for International Application No. PCT/BR2006/000159.
International Preliminary Report on Patentability for International Application No. PCT/BR2006/000150.

(Continued)

*Primary Examiner* — David Walczak
*Assistant Examiner* — Bradley Oliver
(74) *Attorney, Agent, or Firm* — Alston & Bird LLP

(57) ABSTRACT

The present invention relates to a content-reservoir/product applicator assembly that comprises a refill associated to a housing that supports an applicator for applying a product, the assembly being associable, in a detachable and interchangeable manner to a storage package, the storage package storing the assembly. The refill contains cosmetic products and comprises a case; a neck; a housing; and an applicator. The applicator is a substantially spherical, continuous rotary surface and is associated to the housing. The housing is associable to the housing by thermal welding. The refill is made from a squeezable flexible material.

7 Claims, 5 Drawing Sheets

(56) References Cited

U.S. PATENT DOCUMENTS

| | | | | |
|---|---|---|---|---|
| 6,095,708 | A | 8/2000 | Butaud | |
| 7,513,707 | B2 * | 4/2009 | Eggleden | 401/153 |
| 2002/0176733 | A1 * | 11/2002 | Clark et al. | 401/132 |
| 2008/0003052 | A1 * | 1/2008 | Lee et al. | 401/209 |

OTHER PUBLICATIONS

Written Opinion of the International Searching Authority for International Application No. PCT/BR2006/000150.

Response to Written Opinion for International Application No. PCT/BR/2006/000150.

* cited by examiner

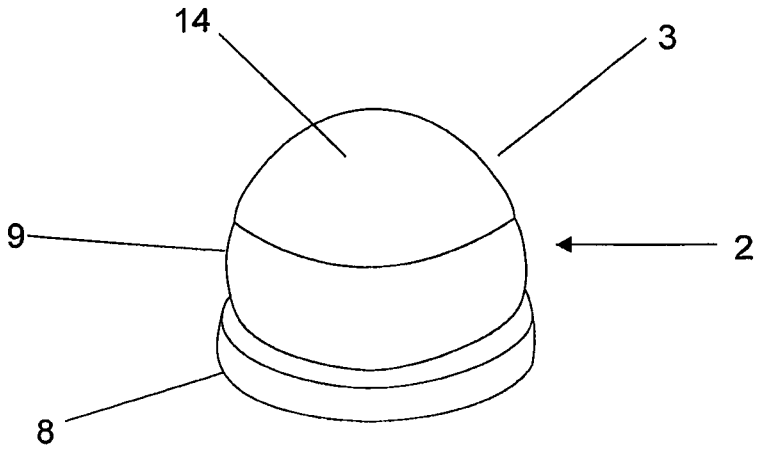
Fig.2
Fig.3
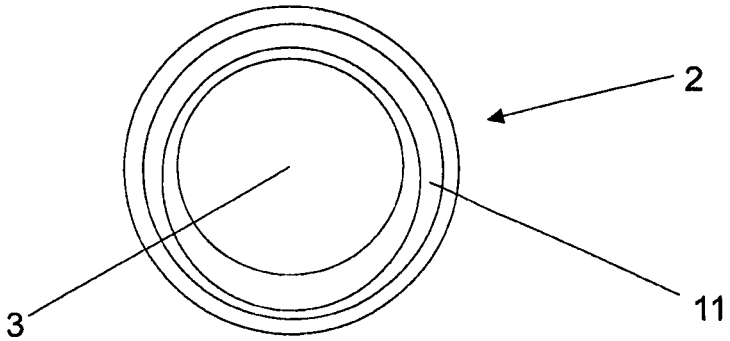

CONTENT-RESERVOIR/PRODUCT-APPLICATOR ASSEMBLIES, AND PACKAGES

The present invention relates to a content-reservoir/product-applicator assembly, especially designed for packing cosmetic products, and a package comprising said assembly.

The present invention also relates to a content-reservoir/product applicator assembly, also especially designed for packing a cosmetic product, for direct use by a user, that is to say, without being packed in a package.

DESCRIPTION OF THE PRIOR ART

There is an increasing concern about the manufacture of a package that will conciliate attractiveness to the consumer and a reduced cost, mainly when its contents is a cosmetic product.

The most usual way of packing cosmetic products consists of pot-type or flask-type packages, provided with an opening at one of their ends, so as to enable one to handle the product at the time of removing the cap.

For the sake of economy, the manufacturers of cosmetics opt for the use of a refill, by which the consumer could obtain a product packed in a pot of flask once and then make successive transfers of the refill into the pot, thus bringing about the continued use of the product. This alternative is considerably advantageous for the consumer, since he can obtain the product at a reduced price, which would even bring about a greater consumption thereof. However, in general, this technique is used with the aid of product applicators, such as spatulas or scoops, which are not always available to the user.

In this scenery, the applicant has developed a content reservoir associated to an applicator, forming an assembly that can be used directly for applying the product, thus eliminating the need to use product applicators, or can be associated with different packages for use as a refill during use.

In addition, the possibility of using said assembly as a refill enables a lower consumption of inputs—raw materials and energy—for making the product accessible to the consumer, thus bringing about reduced wear of material and, as a result, a smaller burden on the environment.

Said assembly can further be used directly by the user, without being packed in a package.

Therefore, said assembly is very practical, versatile, economical and more interesting from the ecological point of view.

OBJECTIVES OF THE INVENTION

A first objective of the present invention is to provide a content reservoir associated to a product applicator that can be used directly by the consumer for applying the product, and can be used as a product refill, thereby enabling a lower consumption of inputs for its manufacture and less wear of the material in the environment.

A second objective of the present invention is to provide a package capable of receiving the reservoir and applicator, as described above.

A third objective of the present invention is to provide a content reservoir associated to a product applicator that can be used directly by the consumer for applying the product, that is to say, said assembly is the package itself, enabling less consumption of inputs for manufacturing the package and less wear of material in the environment.

BRIEF DESCRIPTION OF THE INVENTION

The first objective of the invention is achieved by means of a content-reservoir and product-applicator assembly comprising a content reservoir associated to a housing that supports the application for applying a product, said assembly being associable, in a detachable and interchangeable manner, to a housing package.

The second objective of the present invention is achieved by means of a package that houses a content-reservoir and product-applicator assembly as defined above.

The third objective of the present invention is achieved by means of a content-reservoir and product-applicator comprising a content reservoir associated to a housing that supports an applicator for applying a product; and by means of a package that is a content-reservoir and product-applicator, as defined before.

BRIEF DESCRIPTION OF THE DRAWINGS

The present invention will now be described in greater detail with reference to an embodiment represented in the drawings. The figures show:

FIG. 2 is a perspective view of the product applicator associated to a housing;

FIG. 3 is a bottom view of the product application associated to a housing illustrated in FIG. 2;

DETAILED DESCRIPTION OF THE FIGURES

The present invention provides a content-reservoir 1 and product applicator 3 assembly, especially designed for use as a refill for packing cosmetic products.

By cosmetic products we can understand those that assume the form, for example, of creams, lotions, salves, oils, gels, powders, emulsions, which are used as moisturizers, deodorants, suntan lotions, bases, sun-screens, toilet soaps, shampoos, conditioners, masks, among others.

In spite of the assembly of the present invention being advantageously used as a refill, nothing prevents it from being used in isolation by the user, that is to say, without being housed in a package. This second embodiment becomes very convenient when the user has reduced space for packing the assembly in a purse or bag, for instance, or even when the user prefers to acquire a small assembly for use in a short period of time, generally desired when one goes on a trip. A protective film for covering the application surface of the applicator (14, 15), such as a plastic or laminated film, may be foreseen.

The content reservoir 1 may be made of any material, as long as it is compatible with the product that is being packed, preventing contamination of the product, and as long as it is resistant and impermeable in order to prevent leakage thereof. Preferably, the reservoir 1 is made from a flexible material, such as a metallic laminate or a plastic material. Flexibility is especially advantageous if the reservoir is to be accommodated inside a purse or bag and, in case it is used as a refill, inside a package. In addition, the flexibility of the reservoir 1 enables the user to squeeze it, thus expediting the application of the product.

Figure 1:
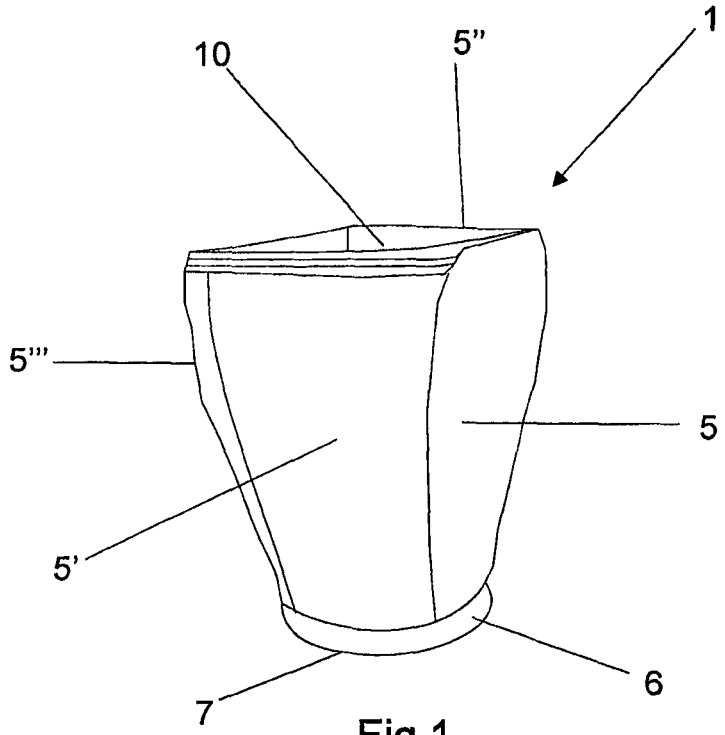
FIG. 1 is a perspective view of the content reservoir.
Figure 4:
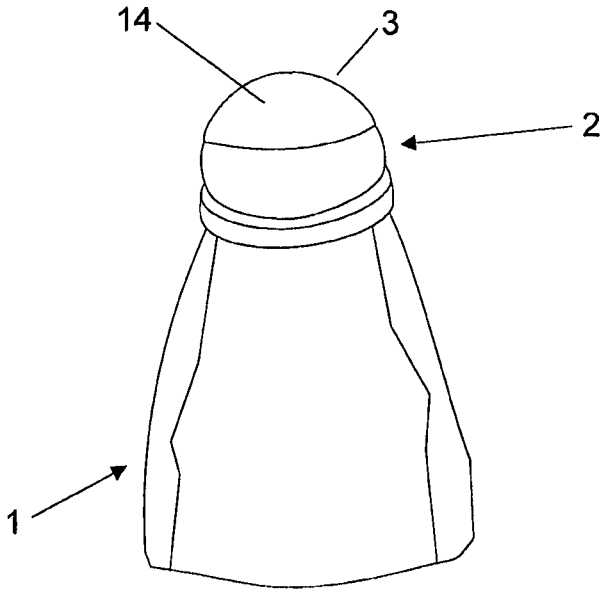
FIG. 4 is a front view of a content reservoir associated to a product applicator.
Figure 5:
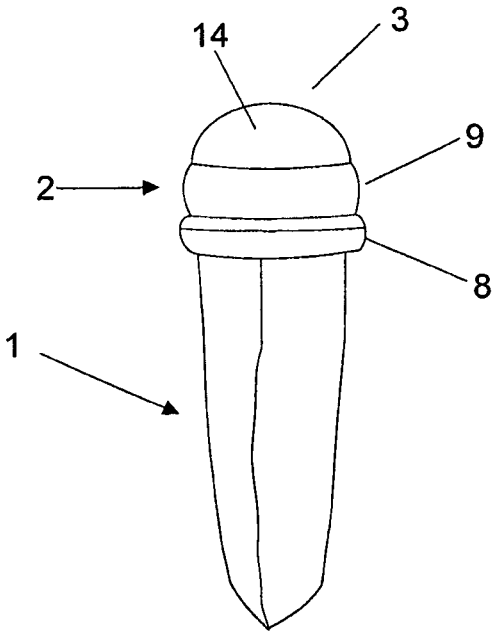
FIG. 5 is a side view of the content reservoir assembly associated to a product applicator illustrated in FIG. 4.

As can be seen in FIG. 1, the content reservoir 1 comprises a case 5 and a neck 6.

Preferably, the case 5 assumes the shape of a pouch, formed from at least one foil 5', preferably two foils (5', 5") linked to each other or four foils (5, ', 5", 5'", 5'") linked two by two, forming the pouch walls.

The neck 6 defines an opening 7 for passage of the content out of the package 4 to its application point. The neck 6 is associated to a housing 2 of a product applicator 3, as will be described later.

When the content reservoir 1 is formed from a single foil 5, said foils 5 is arranged in such a way that its ends are enclosed in the neck 6. When there are more than one foil 5, the connection between them may be made according to conventional methods, for instance, gluing, their first ends being enclosed in the neck 6 and their second opposed ends being enclosed by a base portion 10.

Figure 6A:
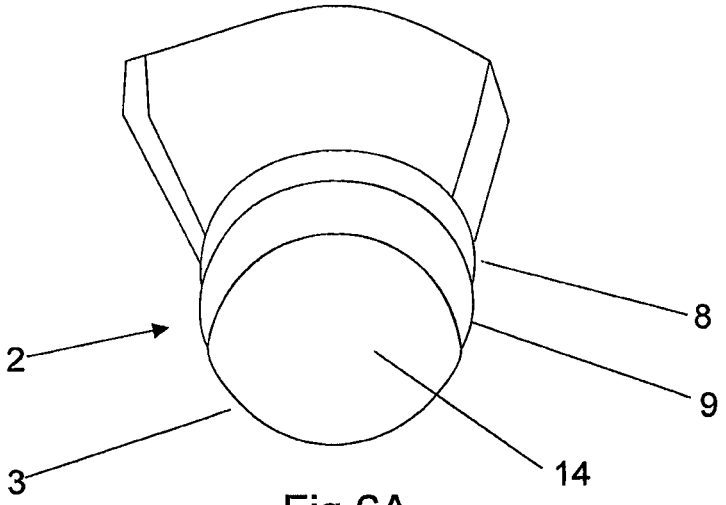
FIG. 6A is a perspective view of a content-reservoir assembly associated to a product applicator illustrated in FIGS. 4 and 5, according to a first embodiment of the invention.
Figure 6B:
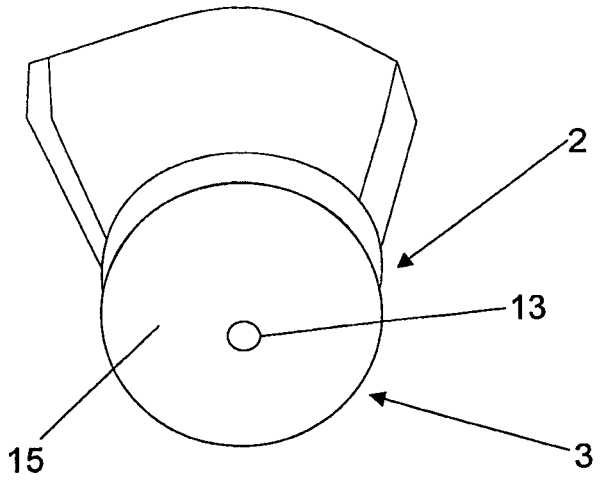
FIG. 6B is a perspective view of a content-reservoir associated to a product applicator, according to a second embodiment of the invention.

The applicator 3 is useful for applying products in liquid, pasty or solid form. For products such as deodorants, the applicator 3 is preferably a substantially spherical continuous rotary surface 14, which upon turning provides application of the product onto the skin of the user, just as the well-known "roll-on". Alternatively, the applicator may assume the shape of a non-rotary semispherical surface 15 and be provided with at least one bore 13, preferably a plurality of bores 13, forming a non-continuous surface 15, for passage of the product towards the application surface. These two embodiments can be seen in FIGS. 6A and 6B.

For products such as talc, the application 3 is preferably a substantially semispherical surface 15, provided with at least one bore 13, preferably a plurality of bores 13, for application of the product onto the user's skin. Other embodiments may also be employed, as long as they enable good application of the product, for instance, laying it on the surface to which it is being applied.

The applicator is associated to a housing 2, as can be seen in FIG. 2, the function of which is to serve as a support for the applicator 3 and helping in the functioning of the applicator 3 when the latter is in use. By preference, the applicator 3 is associated to the housing 2 by locking, gluing, welding, without excluding other methods known from the art.

By preference, the applicator 3 is partly protected by a covering, such as a protective film of cover, not shown. The covered region is the portion of the applicator 3 that is exposed to the outer environment.

In a general way, the applicator 3 either has a free rotation movement or has no movement at all, depending on the product to be applied. These embodiments lead to different forms of functioning, which will be detailed later.

The housing 2 preferably has a truncated-cone shape, its smaller base part facing the application region that is responsible for direct application of the product, and its larger base facing the content reservoir 1.

In a preferred embodiment and as can be seen in FIG. 2, the housing 2 comprises a substantially annular base 8 concentric with a substantially cylindrical cover 9. The cover 9 is arranged between the base 8 and the product applicator 3. Preferably, the product applicator 3 is substantially tangent to the cover 9 throughout its perimeter, so as to allow the product to pass out of the reservoir 1 and reach its application point.

The housing 2 also comprises a recess 11, which serves as a attachment point for the neck 6 of the content reservoir 1, as indicated in FIG. 3.

By preference, the housing 2 and the product application 3 are made from a plastic material, but are not limited to this material.

The content reservoir 1 and the product applicator 3 are associated with each other through the housing 2, forming an assembly that is associable, in a detachable and interchangeable manner, to storage package 4, as can be seen in FIGS. 4, 5 and 6A-6B.

Preferably, the housing 2 and the content reservoir 1 are associated with each other by gluing or ultrasonic or thermal welding. However, any other association means may be used, provided that they allow one to detach and interchange the assembly in different packages 4.

Figure 7:
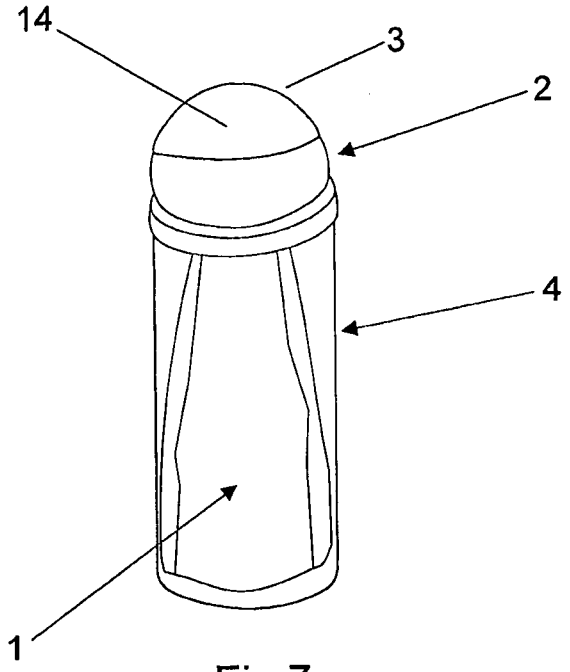
FIG. 7 is a perspective view of a content-reservoir associated to a product applicator arranged in a package.
Figure 8:
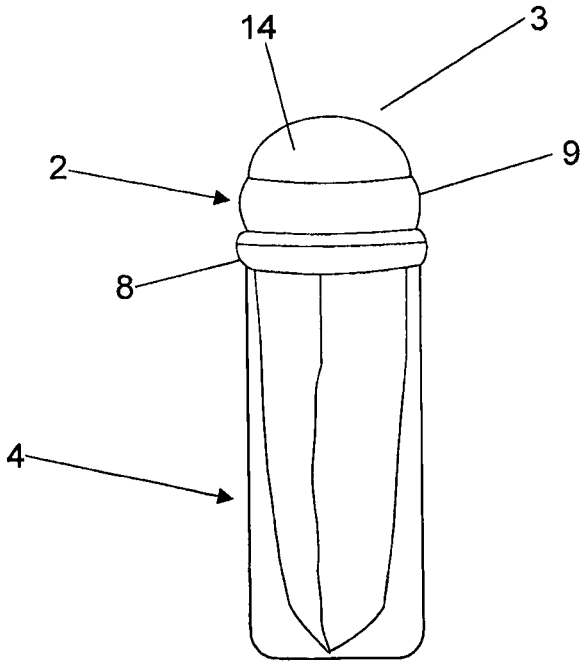
FIG. 8 is a side view of a content-reservoir assembly associated to a product applicator arranged in a package.

The present invention further relates to a package 4 comprising a content-reservoir 1 and product-application assembly 3, as described before and as can be seen in FIGS. 7 and 8. Preferably, this package 4 is provided with a neck 6, through which the assembly will remain associated, and with a cover (not shown).

The neck 6 is associable, in a detachable and interchangeable manner, with the housing 2, which enables the user to use the same assembly in a number of different packages 4. This association is preferably effected at the recess 11 of the housing by gluing, locking, connection or snap fitting, but is not limited to these examples.

Preferably, the package cover should be in plane or flat shape, so as to the package 4 will have its supporting base on the cover itself. This embodiment enables the packed product to be in contact with the applicator 3 by the action of gravity, and then, by a minor rotation of the applicator, the product will promptly be available on the application surface, which will be in contact with the user's skin.

A first form of functioning of the content-reservoir 1 and product-applicator 3 assembly, used directly as a refill, comprises basically the application of a pressure force onto the walls (laminates 5) of the case 5, in the direction from the bottom portion 10 to the neck 6, so that the stored product will be displaced towards the applicator 3. The functioning is of the "roll-on" type, wherein, after a simple turning movement of the applicator 3, the applicator portion that was positioned inside the reservoir 1 and in contact with the product will be available for application to a surface, once said portion has reached the environment external to the reservoir 1.

In a second form of functioning, if the assembly is provided with a cover (not shown), we can consider the fact that the assembly may rest on a plane or flat base of the cover, and thus the product will be permanently in contact with an applicator portion positioned facing the inside of the reservoir 1, due to the action of gravity. In this case, also after a minor turning movement of the applicator 3, the applicator portion 3 that was positioned inside the reservoir 1 and in contact with the product will be available for application to a surface, typically as a "roll-on", as mentioned before.

In case the assembly is associated to a package 4, the functioning principle is similar. With the presence of a package 4 of a flexible material, the functioning will preferably take place by the first form described above. With the presence of a package 4 made of a rigid material, the functioning will preferably take place in the second form of functioning described above.

Of course, the content-reservoir 1 and product-applicator 3 assembly and the package 4 of the present invention may be used for other products than cosmetics, such as food products, for example, mayonnaise, and cleaning products, for example, saponaceous products, and personal hygiene products, for example, toothpaste.

Preferred embodiments having been described, it should be understood that the scope of the present invention embraces other possible variations, being limited only by the contents of the accompanying claims, which include the possible equivalents.

The invention claimed is:

1. A content reservoir/product-applicator and storage package assembly comprising:

a content reservoir comprising:

a case; and a neck;

the case being configured for containing a cosmetic product; and the case being made from a squeezable, flexible material; and a product applicator comprising:

a housing; and an applicator for expelling the cosmetic product from the case;

the applicator being a spherical continuous rotary surface and being associated to the housing; and the housing being associable to the neck by one of gluing, ultrasonic welding, and thermal welding, wherein the neck is configured to permit the passage of the cosmetic product from the case to the applicator and the housing is configured to maintain the applicator in the vicinity of the neck, the applicator being configured to expel the cosmetic product from the case when a pressure force is applied on the case and when the spherical continuous rotary surface of the applicator is turned; and the assembly being associable, in a detachable and interchangeable manner to a storage package configured for storing the assembly, the storage package being made of a squeezable and flexible material and configured to at least partially transfer an applied pressure force to the case, wherein the storage package comprises a second neck being associable, in a detachable and interchangeable manner, to the housing.

2. An assembly according to claim 1 wherein the content reservoir is made from a metalized material.

3. An assembly according to claim 1, wherein the housing comprises a substantially annular base concentric with a substantially cylindrical cover.

4. An assembly according to claim 1, wherein the housing comprises a recess, the recess being configured to effect the association between the housing and the neck.

5. An assembly according to claim 1, wherein the applicator is made from plastic material.

6. An assembly according to claim 1, wherein the case is formed from at least one foil, having its ends enclosed in the neck.

7. An assembly according to claim 6, wherein the foil is formed from two foils linked to each other, having first ends enclosed in the neck and opposite second ends enclosed by a base portion.

* * * * *